United States Patent [19]

Martin

[11] Patent Number: 4,736,686

[45] Date of Patent: Apr. 12, 1988

[54] MISSILES WITH ANNULAR CUTTER ELEMENT WITHIN FAIRING PORTION

[75] Inventor: Ernest C. Martin, Stevenage, United Kingdom

[73] Assignee: British Aerospace PLC, London, England

[21] Appl. No.: 925,238

[22] Filed: Oct. 31, 1986

[30] Foreign Application Priority Data

Oct. 31, 1985 [GB] United Kingdom ..... 8526847

[51] Int. Cl.[4] ..... F42B 4/06

[52] U.S. Cl. ..... 102/351; 102/357; 102/518; 102/519; 102/526

[58] Field of Search ..... 102/343, 344, 351, 506, 102/518, 519, 524, 526, 528, 357

[56] References Cited

U.S. PATENT DOCUMENTS

| | | | |
|---|---|---|---|
| 2,922,366 | 1/1960 | Lyon | 102/52 |
| 3,302,570 | 2/1967 | Marquardt | 102/364 |
| 3,677,181 | 7/1972 | Giljarhus et al. | 102/364 |
| 3,941,057 | 3/1976 | Peterson et al. | 102/364 |
| 3,946,673 | 3/1976 | Hayes | 102/364 X |
| 4,435,887 | 3/1984 | Strandli et al. | 29/123 |
| 4,458,599 | 7/1984 | Mullendore et al. | 102/517 |
| 4,597,333 | 7/1986 | Bocker et al. | 102/518 |
| 4,610,205 | 9/1986 | Bentley | 102/524 X |
| 4,648,324 | 3/1987 | McDermott | 102/518 |

FOREIGN PATENT DOCUMENTS

| | | |
|---|---|---|
| 530433 | 1/1955 | Belgium . |
| 1192170 | 4/1959 | France . |
| 1499347 | 9/1967 | France . |

*Primary Examiner*—Peter A. Nelson

*Attorney, Agent, or Firm*—Cushman, Darby & Cushman

[57] ABSTRACT

A missile having a kinetic energy warhead is disclosed comprising a two-tiered cutter element (12) of fragmenting material and a forward cutter ring (16). The arrangement is designed so that the forward cutter ring (16) penetrates the target outer skin while the two-tiered cutter element fragments and passes through the perforation made by the forward cutter ring.

9 Claims, 1 Drawing Sheet

MISSILES WITH ANNULAR CUTTER ELEMENT WITHIN FAIRING PORTION

BACKGROUND OF THE INVENTION

This invention relates to missiles adapted so that a high proportion of the damage inflicted on a target is caused by the kinetic energy of the missile.

A missile is capable of destroying a target on impact without recourse to explosives provided the missile has sufficient means and impacts the target at sufficient speed. A missile of this type in which a high proportion of the damage inflicted on a target is caused by the kinetic energy of the missile is referred to as a missile having a kinetic energy warhead. It will be appreciated however that components of the missile other than the warhead itself will contribute to the total kinetic energy of the missile. A missile with a kinetic energy warhead has many desirable aspects; it eliminates the complexity, unreliability and costs associated with safety and arming and with fuzing, and all risks arising from premature detonations.

SUMMARY OF THE INVENTION

According to one aspect of this invention, there is provided a missile including a body and a warhead located in a forward portion of said body, said warhead including a frangible cutter element of generally annular section and adapted to fragment on impact with a target.

In one arrangement the warhead device may include a further cutter element of generally annular section located forwardly of said frangible cutter element and adapted to penetrate the external surface of the target prior to fragmentation of said frangible cutter element.

Preferably, said frangible cutter element is formed of fragmenting steel material and said further cutter element is formed of tungsten.

Preferably, said frangible cutter element is scored to assist fragmentation.

BRIEF DESCRIPTION OF THE DRAWINGS

Further aspects of this invention will become apparent from the following description, which is by way of example only, reference being made to the accompanying drawings, in which.

DETAILED DESCRIPTION OF A PREFERRED EMBODIMENT

The kinetic energy warhead to be described below is intended to be used in a missile which will travel at supersonic speeds and which is intended for use against relatively lightly armoured targets.

Figure 1:
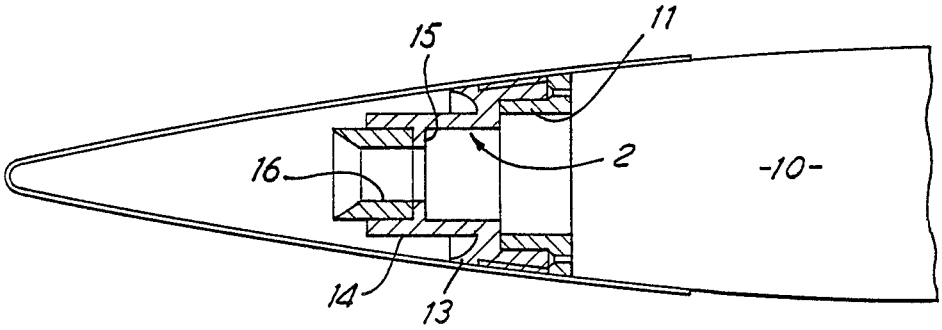
FIG. 1 is a section view through the nose portion of a missile incorporating a kinetic energy warhead.
Figure 2:
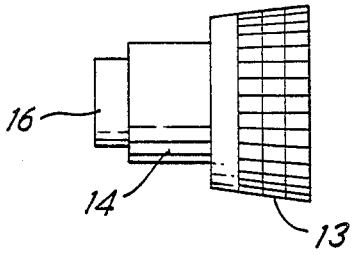
FIG. 2 is a side view of the warhead of FIG. 1.

Referring to the Figures, the missile includes a body 10 housing a hollow cylindrical adaptor 11 on which is fitted a one piece tiered rear cutter 12 of fragmenting steel material and comprising a rear, chisel edged hollow cylindrical cutter ring portion 13 and a forward chisel edged hollow cylindrical cutter ring portion 14 coaxial with the rear cutter ring but of smaller diameter. The external surface of the rear cutter is notched both axially and circumferentially (see FIG. 2) to provide ninety fragments of approximately one gram mass each.

The forward cutter ring portion includes an internally directed annular rib 15 to provide a support for a front cutter ring 16 of tungsten material. The assembly is covered by the nose cone of the missile.

When the missile impacts a target, the front cutter ring 16 penetrates into the interior of the target. The ring configuration allows a larger diameter than could be achieved with a solid section rod of the same mass. The rear cutter 12 is designed to enlarge the perforation made by the front cutter to permit the remainder of the missile or its debris to penetrate the target interior, to break into fragments to increase the volume within the target where damage will be caused and to transmit the impact loads from the front cutter to the remainder of the warhead in order to cause that to fragment.

I claim:

1. A missile including an elongated body portion, a nose fairing portion projecting forwardly of said body portion and a kinetic energy warhead secured to said body portion and located within said fairing portion, said kinetic energy warhead including a generally annular cutter element formed to fragment into a plurality of fragments when the missile impacts a target.

2. A missile according to claim 1, wherein said warhead includes a further cutter element of generally annular section located forwardly of said frangible cutter element and adapted to penetrate the surface of the target prior to fragmentation of said frangible cutter element.

3. A missile according to claim 1, wherein said frangible cutter element is formed of fragmenting steel, and said further cutter element is formed of tungsten material.

4. A missile according to claim 1 wherein said frangible cutter element is scored to assist fragmentation.

5. A missile according to claim 2, wherein said frangible cutter element comprises a rearward generally annular cutter portion and a concentric forward generally annular cutter portion of smaller diameter than said rearward generally annular cutter portion, and a rearward part of said further cutter element is received within said forward cutter portion.

6. A missile including an elongated body portion, a nose fairing portion projecting forwardly of said body portion and a kinetic energy warhead secured to said body portion and located within said fairing portion, said kinetic energy warhead including a first generally annular cutter element formed to fragment into a plurality of fragments when the missile impacts a target, and a second generally annular cutter element of reduced diameter relative to said first cutter element and disposed generally concentrically with said first cutter element, with the leading edge of said second cutter element lying forwardly of the leading edge of said first cutter element, whereby on impact with a target, said second cutter element penetrates the surface of the target prior to fragmentation of said first cutter element.

7. A missile according to claim 6, wherein said first cutter element is scored to assist fragmentation.

8. A missile according to claim 6, wherein said first cutter element is formed of fragmenting steel, and said second cutter element is formed of tungsten or tungsten alloy.

9. A missile according to claim 6, wherein said first cutter element comprises a rearward, generally annular, cutter portion and a concentric forward generally annular support portion of smaller diameter than said rearward generally annular cutter portion, said support portion supporting said second cutter element in load-transfer relationship, whereby on impact with a target, impact loads are transmitted between said first cutter element and said second cutter element.

* * * * *